US007997166B2

(12) United States Patent
Lauzon et al.

(10) Patent No.: US 7,997,166 B2
(45) Date of Patent: Aug. 16, 2011

(54) METHODS AND APPARATUS FOR JOINT DISASSEMBLY

(75) Inventors: Michel Armand Lauzon, Haileybury (CA); Rejean Leonel Plante, Callander (CA); David Robert Ritter, North Bay (CA)

(73) Assignee: Longyear TM, Inc., South Jordan, UT (US)

( * ) Notice: Subject to any disclaimer, the term of this patent is extended or adjusted under 35 U.S.C. 154(b) by 152 days.

(21) Appl. No.: 12/138,297

(22) Filed: Jun. 12, 2008

(65) Prior Publication Data

US 2008/0307932 A1 Dec. 18, 2008

Related U.S. Application Data

(60) Provisional application No. 60/944,163, filed on Jun. 15, 2007.

(51) Int. Cl.
*B25B 13/52* (2006.01)
*B25B 13/00* (2006.01)

(52) U.S. Cl. ..... 81/57.34; 81/69; 81/57.36

(58) Field of Classification Search ..... 81/57.34, 81/69, 57.36, 64, 65.2, 68, 70, 65, 57.32
See application file for complete search history.

(56) References Cited

U.S. PATENT DOCUMENTS

| | | | | |
|---|---|---|---|---|
| 430,994 | A * | 6/1890 | Ely | 81/65.2 |
| 621,293 | A * | 3/1899 | Crass | 81/69 |
| 712,253 | A * | 10/1902 | Brwon et al. | 81/69 |
| 1,416,685 | A * | 5/1922 | Bufford | 81/69 |
| 2,633,045 | A | 3/1953 | Benjamin | |
| 2,650,070 | A | 8/1953 | Lundeen | |
| 2,921,489 | A * | 1/1960 | Schweitzer | 81/69 |
| 2,928,301 | A | 3/1960 | Beeman | |
| 2,933,961 | A | 4/1960 | Adams | |
| 2,989,880 | A | 6/1961 | Hesser et al. | |
| 3,880,024 | A | 4/1975 | Asada | |
| 3,892,140 | A | 7/1975 | Fox et al. | |
| 4,079,640 | A | 3/1978 | Golden | |
| 4,212,212 | A | 7/1980 | Chandler et al. | |
| 4,221,269 | A | 9/1980 | Hudson | |
| 4,324,157 | A | 4/1982 | Soutsos | |
| 4,485,697 | A | 12/1984 | Heilhecker et al. | |

(Continued)

FOREIGN PATENT DOCUMENTS

DE 29720465 1/1998

(Continued)

OTHER PUBLICATIONS

U.S. Appl. No. 61/052,577, filed May 12, 2008, Trevor Lyndon Light.

(Continued)

*Primary Examiner* — Hadi Shakeri
(74) *Attorney, Agent, or Firm* — Workman Nydegger

(57) ABSTRACT

A joint tool includes a first wrench assembly configured to be placed in gripping contact with a rod, a second wrench assembly including jaws configured to grip and rotate a rod when the second wrench assembly is rotated in a first direction and to rotate relative to the rod when moved in a second direction, the second direction being opposite the first direction, and a drive assembly mounted to the first wrench assembly and coupled to the second wrench assembly, the drive assembly being configured to rotate the rod in the first direction and the second direction.

25 Claims, 9 Drawing Sheets

U.S. PATENT DOCUMENTS

| | | | | |
|---|---|---|---|---|
| 4,512,216 | A | | 4/1985 | Callegari, Sr. et al. |
| 4,604,922 | A | | 8/1986 | Soutsos |
| 4,683,962 | A | | 8/1987 | True |
| 4,694,712 | A | | 9/1987 | Doss |
| 4,765,401 | A | | 8/1988 | Boyadjieff |
| 4,843,924 | A | | 7/1989 | Hauk |
| 4,885,963 | A | * | 12/1989 | Nishikawa ..... 81/57.32 |
| 4,895,056 | A | | 1/1990 | Schulze-Beckinghausen |
| 5,054,550 | A | | 10/1991 | Hodge |
| 5,060,542 | A | | 10/1991 | Hauk |
| 5,092,411 | A | | 3/1992 | Hausherr et al. |
| 5,207,128 | A | | 5/1993 | Albright |
| 5,320,021 | A | | 6/1994 | Heintz |
| 5,435,213 | A | | 7/1995 | Buck |
| 5,660,087 | A | | 8/1997 | Rae |
| 5,845,549 | A | | 12/1998 | Bouligny |
| 5,868,045 | A | | 2/1999 | Hauk |
| 5,931,231 | A | | 8/1999 | Mock |
| 6,050,156 | A | | 4/2000 | Buck |
| 6,070,500 | A | | 6/2000 | Dlask et al. |
| 6,082,225 | A | | 7/2000 | Richardson |
| 6,318,199 | B1 | | 11/2001 | Buck |
| 6,634,443 | B1 | | 10/2003 | Paech et al. |
| 6,910,402 | B2 | | 6/2005 | Drzewiecki |
| 6,971,283 | B2 | | 12/2005 | Belik |
| 7,000,502 | B2 | | 2/2006 | Belik |
| 7,117,938 | B2 | | 10/2006 | Hamilton et al. |
| 7,188,547 | B1 | | 3/2007 | West et al. |
| 7,191,686 | B1 | | 3/2007 | Angelle et al. |
| 2002/0157823 | A1 | | 10/2002 | Pietras et al. |
| 2003/0177870 | A1 | | 9/2003 | Neves et al. |
| 2003/0221871 | A1 | | 12/2003 | Hamilton |
| 2005/0072274 | A1 | | 4/2005 | Hauk et al. |
| 2006/0053977 | A1 | | 3/2006 | Hawkins, III |
| 2006/0054331 | A1 | | 3/2006 | Hawkins, III |
| 2006/0179980 | A1 | | 8/2006 | Pietras et al. |
| 2006/0243490 | A1 | | 11/2006 | Riel |
| 2007/0017703 | A1 | | 1/2007 | Belik |
| 2010/0083796 | A1 | | 4/2010 | Nelson |

FOREIGN PATENT DOCUMENTS

| | | |
|---|---|---|
| DE | 20202396 | 6/2002 |
| EP | 1644608 EP | 11/2007 |
| JP | 62-156468 | 10/1987 |
| JP | S62-156468 | 10/1987 |
| JP | 07-062968 | 3/1995 |
| JP | 09-250285 | 9/1997 |
| JP | 2652808 | 9/1997 |
| JP | 2002-194984 | 7/2002 |
| JP | 2003-184471 | 7/2003 |
| WO | WO98/26153 | 6/1998 |
| WO | WO99/06186 | 2/1999 |
| WO | WO99/55728 | 11/1999 |
| WO | WO03/033858 | 4/2004 |
| WO | PCT/US2008/067007 | 12/2008 |
| WO | PCT/US2009/043628 | 10/2009 |
| WO | PCT/US2009/043633 | 12/2009 |
| WO | PCT/US2008/074499 | 3/2010 |

OTHER PUBLICATIONS

U.S. Appl. No. 12/119,385, filed Jun. 12, 2008, Keith William Littely.
U.S. Appl. No. 12/197,817, filed Aug. 25, 2008, Kruse, et al.
International Search Report dated Dec. 23, 2008 from PCT/US2008/067007 (4 pages).
Written Opinion dated Dec. 23, 2008 from PCT/US2008/067007 (6 pages).
Written Opinion dated Dec. 1, 2009 from PCT/US2009/043633 (3 pages).
Written Opinion dated Oct. 28, 2009 from PCT/US2009/043628 (5 pages).
International Search Report dated Jan. 21, 2009 from PCT/US2008/074499 (3 pages).
Written Opinion dated Jan. 21, 2009 from PCT/US2008/074499 (4 pages).
U.S. Appl. No. 12/197,817, filed Jan. 13, 2010, Restriction Requirement.
U.S. Appl. No. 12/119,385, filed Mar. 3, 2010, Office Action.
U.S. Appl. No. 12/197,817, filed May 20, 2010, Office Action.
Notice of Allowance dated Sep. 24, 2010 from U.S. Appl. No. 12/119,385, filed May 12, 2008 (8 pages).
Office Action dated Oct. 13, 2010 from U.S. Appl. No. 12/197,817, filed Aug. 25, 2008 (5 pages).
Office Action dated Jan. 27, 2011 from Australian Patent Application No. 2008265945 filed Jun. 13, 2008 (2 pages).
Office Action dated Jan. 31, 2011 from U.S. Appl. No. 12/464,707 filed May 12, 2009 (13 pages).
Notice of Allowance dated Feb. 3, 2011 from U.S. Appl. No. 12/197,817 filed Aug. 25, 2008 (12 pages).
Notice of Allowance dated May 19, 2011 from U.S. Appl. No. 12/464,707 filed May 12, 2009 (16 pages).
Notice of Allowance dated Apr. 21, 2011 from U.S. Appl. No. 12/197,817 filed Aug. 25, 2008 (6 pages).
Supplemental Notice of Allowance dated May 3, 2011 from U.S. Appl. No. 12/197,817 filed Aug. 25, 2008 (4 pages).
Office Action dated Jan. 21, 2011 from U.S. Appl. No. 12/197,817 filed Aug. 25, 2008 (7 pages).
Issue Notification dated Nov. 23, 2010 from U.S. Appl.No. 12/119,385 filed May 12, 2008 (1 page).

* cited by examiner

METHODS AND APPARATUS FOR JOINT DISASSEMBLY

RELATED APPLICATIONS

This application claims the benefit of U.S. Provisional Patent Application Ser. No. 60/944,163 filed Jun. 15, 2007, which is hereby incorporated by reference in its entirety.

FIELD

This application relates generally to apparatus for disassembling threaded joints, as well as methods for using such apparatus. In particular, this application relates to an apparatus for disassembling joints in pipes or rods, as well as methods for using such apparatus.

BACKGROUND OF THE INVENTION

The process of drilling, especially in subterranean formations, often involves lifting numerous sections of drill rod and/or casings into place and then connecting the sections together at the joints. The connected sections form a drill string, which is often tipped with a drill bit. Frequently, the joints on the drill rods or casings include male and female threads that may be connected together. During the drilling process, a drill rig applies an axial force and rotates the drill string, often causing these joints to become very tight.

Generally, if the drill string is removed from the borehole (the hole created during drilling) for any reason (e.g., to replace or repair the drill bit), the entire string of drill rods may need to be removed by tripping it out of the borehole, section by section. As this is done, each of the joints for the rods, which now may be extremely tight, may have to be broken and the male and female ends of adjacent rods may need to be separated. In some instances, multiple drill rod sections, which are typically around 5, 10, or 20 feet, may be connected to form a string that extends for very long distances. Thus, a single drill string may have hundreds of joints that may need to be broken and separated.

In many instances, in order to break the joint, the joint is positioned to place the joint near a foot clamp that is located near the bottom of the rig. The foot clamp then clamps the rod while large mechanisms powered by the rig break the joint. In some instances, however, it may be difficult or impractical to position the joint near the foot clamp portion of the drill rig.

Currently, to break and unscrew a joint that is not positioned within the envelope of the foot clamp, several conventional methods are used. First, if possible, the joint can be broken manually using a rigid pipe wrench to break the joint. Second, breaking of the joint may be aided by the power of the rig, using a rigid pipe wrench that is optionally secured against flying off in the event of a failure. And finally, the joint may be broken using whatever it takes to break the joint, i.e., snipes, come-alongs, chain blocks, etc. Such processes may be slow, time consuming, dangerous, and costly because of the cost of labor and the lost opportunity cost.

BRIEF SUMMARY OF THE INVENTION

In at least one example, a joint tool includes a first wrench assembly configured to be placed in gripping contact with a rod. The joint tool also includes a second wrench assembly including jaws configured to grip and rotate the rod when the second wrench assembly is moved in a first direction and to rotate relative to the rod when the second wrench assembly is moved in a second direction that is opposite the first direction.

The joint tool further includes a drive assembly mounted to the first wrench assembly and coupled to the second wrench assembly. The drive assembly is configured to rotate the rod in the first direction and the second direction.

A joint tool may also include a fixed wrench assembly configured to be grippingly secured to a rod, a drive assembly coupled to the fixed wrench assembly, and a floating wrench assembly configured to be coupled to the drive assembly. The floating wrench assembly includes a wrench body, a fetter, and at least one coupler coupling the fetter to the wrench body. The floating wrench assembly may further include at least one jaw configured to grip and rotate the rod when the floating wrench assembly is rotated in the first direction and to slip relative to the rod when the floating wrench assembly is rotated in a second direction that is opposite the first direction. The drive assembly is configured to be mounted to the fixed wrench assembly and coupled to the floating wrench assembly to thereby move the floating wrench assembly in the first direction and the second direction.

A method of breaking a joint between a first rod and a second rod is provided that includes placing a fixed wrench assembly into gripping contact with the first rod on a first side of the joint, mounting a drive assembly to the fixed wrench assembly, coupling a floating wrench assembly to the drive assembly, and placing the floating wrench assembly into engagement with a second rod on a second side of the joint that is opposite the first side. The floating wrench assembly is configured to grip and rotate the second rod when rotated in a first direction and to slip over the second rod when rotated in a second direction that is opposite the first direction. The drive assembly may then be actuated to rotate the floating wrench in the first direction.

BRIEF DESCRIPTION OF THE DRAWINGS

The following description can be better understood in light of the following Figures, in which.

Figure 1A:
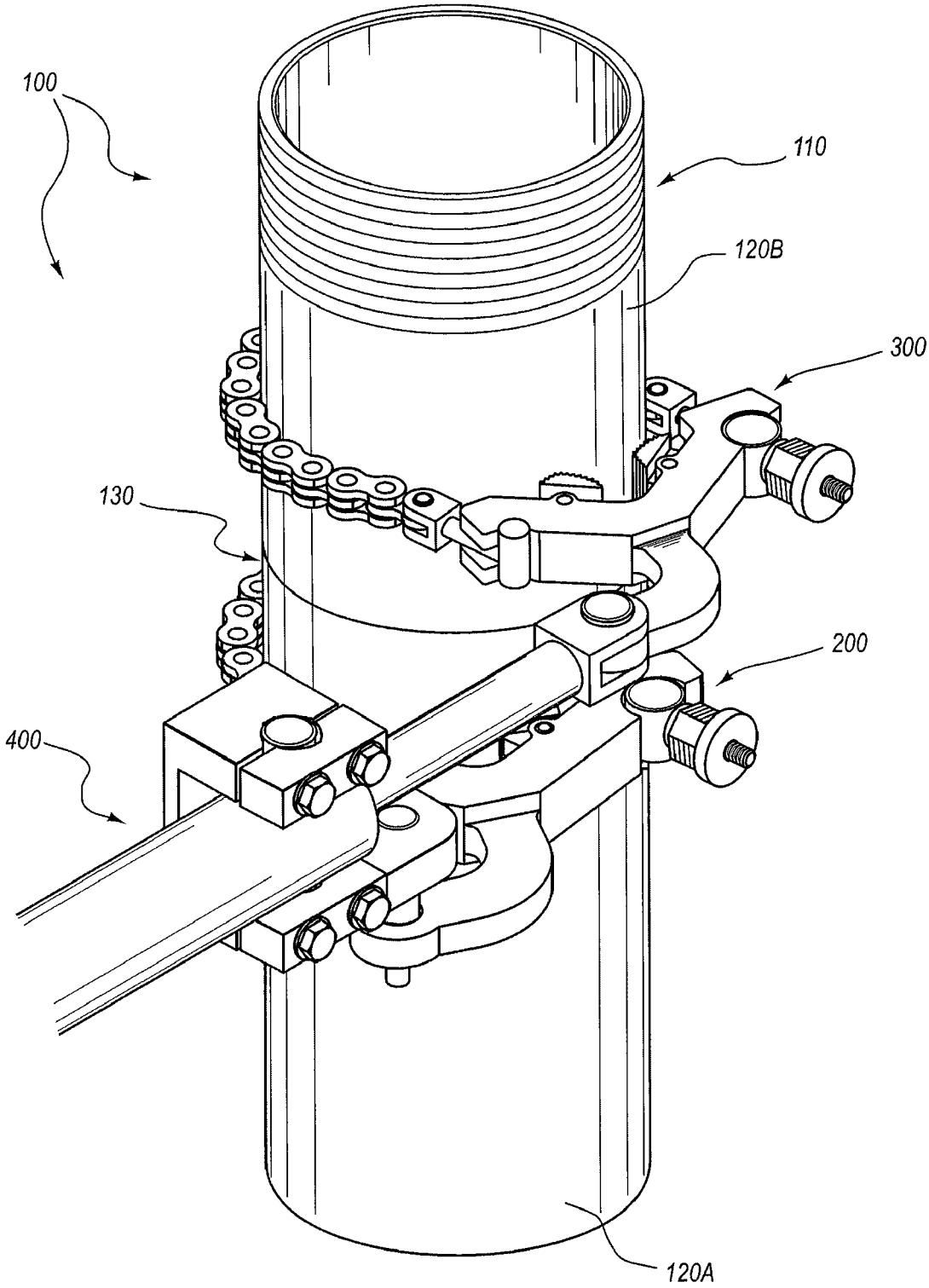
FIG. 1A is a perspective view of a joint tool according to one example.

Together with the following description, the Figures demonstrate and explain the principles of the apparatus and methods for using the apparatus. In the Figures, the thickness and configuration of components may be exaggerated for clarity.

The same reference numerals in different Figures represent similar, though not necessarily identical, components.

DETAILED DESCRIPTION OF THE PREFERRED EMBODIMENTS

A joint tool is provided herein that is configured to break joints between various components of a drill string. Methods are also provided for breaking joints. For ease of reference, joints between rods will be described below. In at least one example, the joint tool includes three assemblies: a fixed wrench assembly, a floating wrench assembly, and a drive assembly. The fixed wrench assembly may be located on one side of a joint. The drive assembly can then be mounted to the fixed wrench assembly. The floating wrench assembly can then be coupled to the drive assembly and then to an opposite side of the joint as the fixed wrench assembly. At least the floating wrench assembly includes jaws that grip a rod as it rotates in a first direction, sometimes referred to as a breaking direction. The jaws slip past the rod as the jaws rotate in the opposite or second direction. The drive assembly is configured to move the floating wrench assembly in the first direction such that the floating wrench assembly grips the rod and rotates the rod relative to the fixed wrench assembly to thereby break the joint.

The configuration described above may allow the joint tool to be readily portable and quickly installed. Further, the configuration of the floating wrench assembly may allow the joint tool to not only break a joint, but to unthread the joint as well by reciprocating movement of the floating wrench assembly. Portability and ease of installation of the joint tool may increase the productivity of a drill rig by reducing the time associated with breaking joints and/or unthreading rods or other drill string components.

The following description supplies specific details in order to provide a thorough understanding. Nevertheless, the skilled artisan would understand that the apparatus and associated methods of using the apparatus may be implemented and used without employing these specific details. Indeed, the apparatus and associated methods can be placed into practice by modifying the illustrated apparatus and associated methods and can be used in conjunction with any apparatus and techniques conventionally used in the industry. For example, while the description below focuses on joint tools for breaking and/or making drill rod joints; this apparatus may be implemented in many other applications, such as connecting and/or disconnecting any two tubular or cylindrical objects by twisting one of the objects relative to the other. Examples of such tubular or cylindrical objects include: piping, such as household piping or industrial piping; bits; rods, such as casing rods; reaming shells; water swivels; core barrel components; down-hole tools; and so forth. Accordingly, the description of a rod will be understood to be equally applicable to such tubular or cylindrical objects.

Figure 1B:
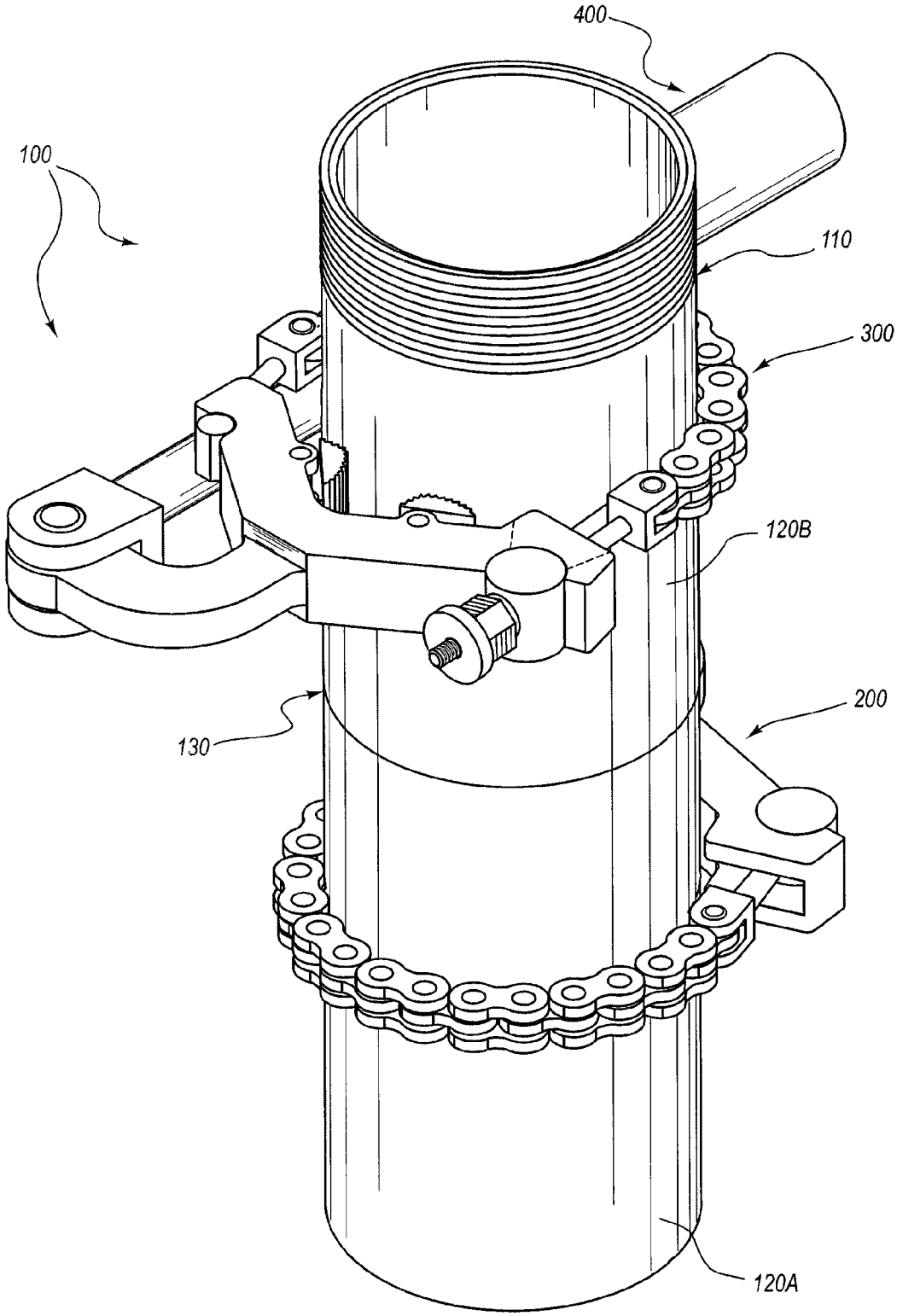
FIG. 1B illustrates an alternative perspective view of the joint tool of FIG. 1A.
Figure 1C:
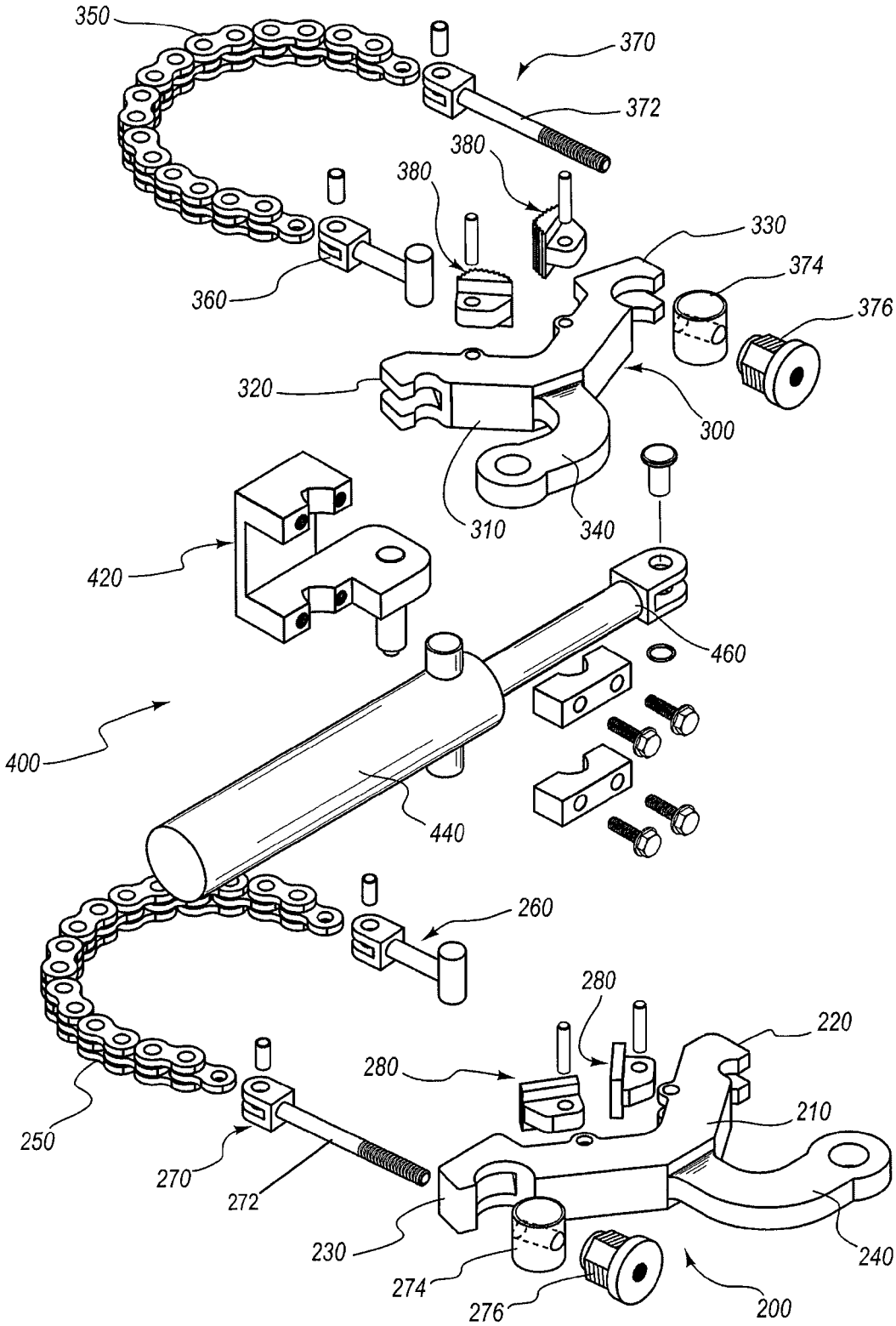
FIG. 1C illustrates an exploded view of the joint tool of FIG. 1A.

FIGS. 1A-1C illustrates an apparatus for joint disassembly, hereinafter referred to as a joint tool 100. As illustrated in FIGS. 1A-1C, the joint tool 100 generally includes opposing wrench assemblies. In the illustrated example, the opposing wrench assemblies include a fixed wrench assembly 200 and a floating wrench assembly 300. In the illustrated example, a drive assembly 400 is mounted to the fixed wrench assembly 200. The floating wrench assembly 300 is further coupled to the drive assembly 400.

The joint tool 100 is configured to break a joint between connected elongate members, such as components of a drill string 110. In the illustrated example, the drill string 110 includes a first drill rod 120A and a second drill rod 120B that are secured together at a joint 130. One exemplary method of breaking a joint with the joint tool 100 will first be introduced. While one method is described, it will be appreciated that the steps may be performed in any order, some steps may be omitted, and additional steps may be performed to break a joint with a joint tool 100.

In order to break the joint 130, the fixed wrench assembly 200 may first be secured to the first drill rod 120A. The fixed wrench assembly 200 may be secured to the first drill rod 120A in such a manner as to minimize rotation of the fixed wrench assembly 200 relative to the second drill rod 120A. Coupling the fixed wrench assembly 200 to the first drill rod 120A in such a manner as to reduce or eliminate relative rotation between the fixed wrench assembly 200 and the first drill rod 120A may be referred to as gripping.

After the fixed wrench assembly 200 has been moved into gripping engagement with the first drill rod 120A, the drive assembly 400 may then be secured or mounted to the fixed wrench assembly 200. In at least one example, the driving assembly 400 may be secured to the fixed wrench assembly 200 in such a manner as to minimize rotation between the fixed wrench assembly and the drive assembly 400. In other examples, the drive assembly 400 may be coupled to the fixed wrench assembly 200 in a manner to allow any degree of rotation between the fixed wrench assembly 200 and the drive assembly 400 as desired.

Once the drive assembly 400 has been secured to the fixed wrench assembly 200, the floating wrench assembly 300 can then be secured to the drive assembly 400 in such a manner as to locate the floating wrench assembly 300 on the opposite side of the joint 130 as the fixed wrench assembly 200. This location may bring the floating wrench assembly 300 into initial engagement with the second drill rod 120B. The engagement may include coupling the floating wrench assembly 300 to the second drill rod 120B in such a manner that there is sufficient tension between the floating wrench assembly 300 and second drill rod 120B to maintain contact between the two but less tension than would cause the floating wrench assembly 300 to grip the second drill rod 120B. Accordingly, such engagement may allow for some initial rotation between the floating wrench assembly 300 and the second drill rod 120B.

The drive assembly 400 may then be actuated to break the joint 130. In at least one example, the power to actuate the drive assembly 400 may be provided by a portable pack or by an auxiliary power pack on a drill rig. Actuation of the drive assembly 400 may be used to cause the floating wrench assembly 300 to grip the second drill rod 120B. For ease of reference, the drive assembly 400 will be described as moving between a retracted position and an extended position. As the drive assembly 400 moves toward the extended position, the drive assembly 400 causes the floating wrench assembly 300 to grip and rotate the second drill rod 120B in a first direction. The first direction may also be referred to as a breaking direction, which may be a counterclockwise rotation.

In at least one example, the floating wrench assembly 300 includes jaws that come into initial contact with the second drill rod 120B when the floating wrench assembly 300 engages the second drill rod 120B as described above. Rotation of the floating wrench assembly 300 in the breaking direction by the drive assembly 400 causes the jaws to move in such a manner as to cause gripping contact between the floating wrench assembly 300 and the second drill rod 120B. This gripping contact may be maintained as the drive assembly 400 further rotates the floating wrench assembly 300 in the breaking direction to thereby rotate the second drill rod 120B.

Once the drive assembly 400 has reached a fully extended position, the drive assembly 400 may be moved toward a retracted position. In at least one example, as the drive assembly 400 moves toward the retracted position, the drive assembly 400 rotates the floating wrench assembly 300 in a second or tightening direction that is opposing the breaking direction.

Rotation of the floating wrench assembly 300 in the tightening direction may result in movement of the jaws associated with the floating wrench assembly 300 that causes the jaws to move out of gripping contact with the second drill rod 120B, which in turn allows the floating wrench assembly 300 to rotate relative to the second drill rod 120B. The drive assembly 400 may then be extended again to cause the floating wrench assembly 300 to grip and rotate the drill rod 120B as the floating wrench assembly 300 rotates in the breaking direction. This process may be repeated as desired to unthread the second drill rod 120B from the first drill rod 120A. Accordingly, breaking and unthreading may be accomplished by a single joint tool.

In at least one example discussed herein, the fixed wrench assembly can include a wrench body and a fetter that is secured to the wrench body by one or more couplers. Further, the floating wrench assembly can also include a fetter secured to a wrench body by one or more couplers. Further, in at least one of the examples discussed below, the drive assembly is configured to extend in a generally linear fashion to cause rotation of the floating wrench assembly. In at least one of such examples, the rotation of the floating wrench assembly causes the gripping contact with a rod described above.

One exemplary configuration of a joint tool 100 will now be discussed in further detail with reference to FIG. 1C. The fixed wrench assembly 200 illustrated in FIG. 1C generally includes a wrench body 210 having a first engagement arm 220, a second engagement arm 230, and a lever arm 240. A fetter 250 may be removably coupled to the wrench body 210 by one or more couplers, such as a first coupler 260 and a second coupler 270. The first coupler 260 and the second coupler 270 may be configured to allow the fetter 250 to be rapidly secured to and/or removed from the wrench body 210. Further, fetters of varying lengths may be interchanged as desired. Interchanging fetters of varying lengths allows the wrench body 210 to break joints in rods of varying diameters.

As illustrated in FIG. 1C, the floating wrench assembly 300 may be similar to the fixed wrench assembly 200. Accordingly, the floating wrench assembly 300 generally includes a wrench body 310 having a first engagement arm 320, a second engagement arm 330, and a lever arm 340. A fetter 350 may be removably coupled to the wrench body 310 by one or more couplers, such as a first coupler 360 and a second coupler 370.

The drive assembly 400 generally includes a mount 420, a cylinder 440 secured to the mount 420, and a rod 460 operatively associated with the cylinder 440. In the illustrated example, the fixed wrench assembly 200 is coupled to mount 420 while the floating wrench assembly 300 is coupled to the rod 460. Additional details regarding the exemplary fixed wrench assembly 200 will be discussed with reference to FIG. 2, regarding the floating wrench assembly 300 will be discussed with reference to FIG. 3, and regarding the drive assembly 460 will be described in more detail with reference to FIG. 4.

As previously introduced, the fixed wrench assembly 200 generally includes the wrench body 210 and the fetter 250. The wrench body can have any desired shape and any number of engagement arms. In the example illustrated in FIG. 2, the first engagement arm 220 and the second engagement arm 230 define a span as they form a broad V-shape. In other examples, the first engagement arm 220 and second engagement arm 230 form other shapes as they defined a span.

The wrench body 210 may be of any desired size and thus may be designed for use on rods of various sizes. For example, the first engagement arm 220 and the second engagement arm 230 may span about 0.5 inches to about 60 inches. Accordingly, the fixed wrench assembly 200 may be used on rods of varying sizes, such on pipes as small as household pipes to large industrial piping. In some instances, though, the wrench body 210 may span almost seven and a half inches between the first engagement arm 220 and the second engagement arm 230.

Figure 2:
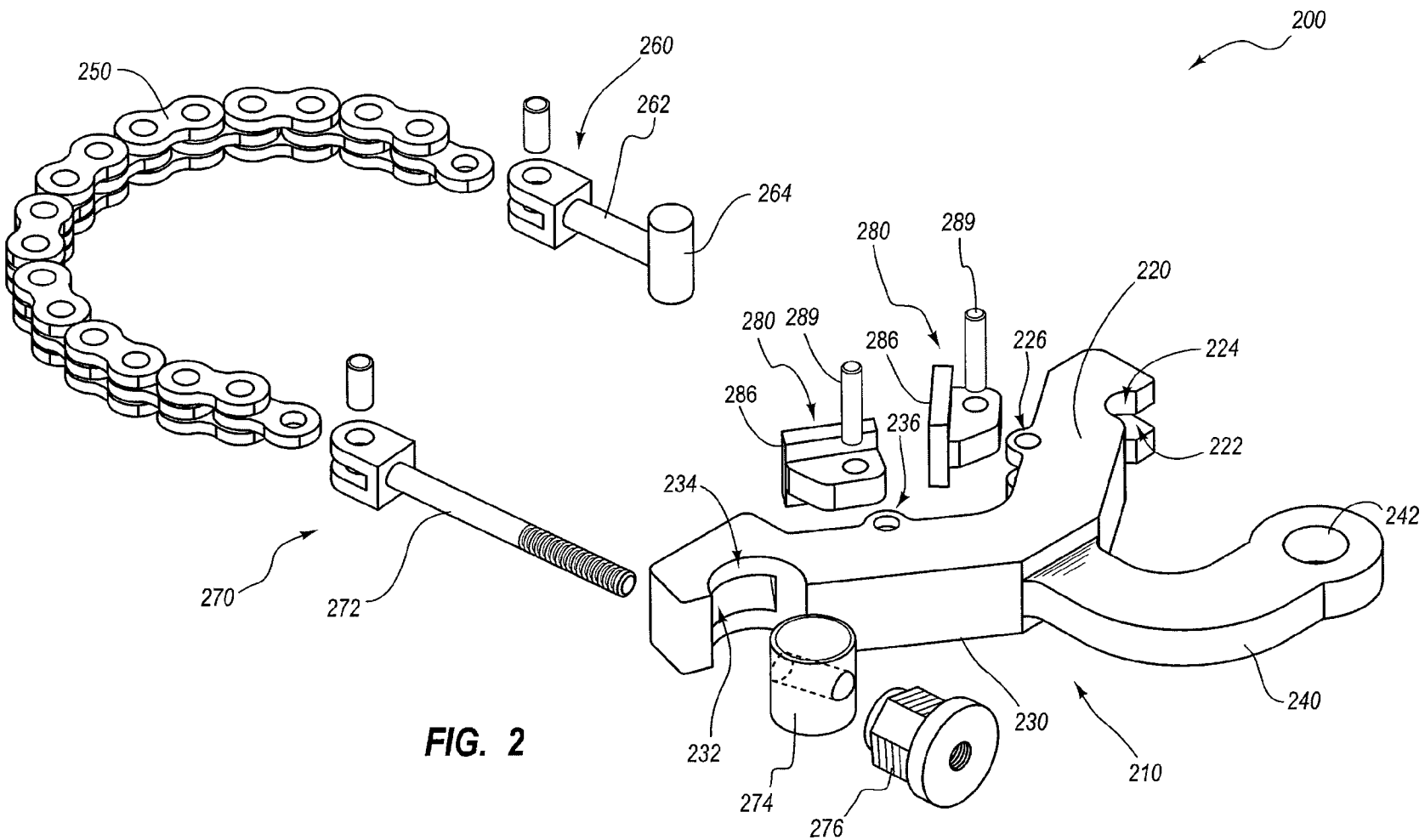
FIG. 2 illustrates an exploded view of a fixed wrench assembly according to one example.

FIG. 2 further illustrates that the fetter 250 can be removably coupled to the first engagement arm 220 by the first coupler 260 and to the second engagement arm 230 by the second coupler 270. In particular, the first engagement arm 220 may include a channel 222 defined therein that is in communication with a recess 224. The first coupler 260 in turn may include a transverse member 262 that is configured to enter the channel 222 as well as extend therethrough. The first coupler 260 further includes a pivot pin 264 secured to the transverse member 262. The pivot pin 264 is configured to engage the recess 224 in such a manner that may allow the first coupler 260 to pivot relative to the first engagement arm 220 while the two are engaged.

The second coupler 270 can also be configured to be coupled to the second engagement arm 230 in such a manner that the second coupler 270 is able to rotate relative to the second engagement arm 230 while the two are engaged. In particular, the second engagement arm 230 may include a hole 232 defined therein that is in communication with a recess 234. The second coupler 270 in turn may include a threaded rod 272, a swivel 274, and a nut 276. The threaded rod 272 may be configured to pass through the hole 232 and through the swivel 274. The swivel 274 in turn may be sized to engage the second engagement arm 230 at the recess 234.

The nut 276 may then be screwed on to the threaded rod 272 to thereby maintain the swivel 274 in engagement with the second engagement arm 230 at the recess 234. As the nut 276 is further threaded onto the threaded rod 272, the threaded rod 272 advances through the nut 276 thereby drawing the fetter 250 closer to the second engagement arm 230.

If a rod is located between the fetter 250 and the wrench body 210, drawing the fetter 250 toward the second engagement arm 230 can tension the fixed wrench assembly 200 to the rod. In at least one example, the nut 276 may be configured to be tensioned in such a manner as to rigidly secure the fixed wrench assembly 200 to the rod. In such an example, the nut 276 may be of a shape and/or size to allow a wrench or other tightening device to engage the nut 276. In other examples, the nut be sized and/or shaped to be tightened by hand or by any other method to tighten the fixed wrench assembly 200 to a rod.

Accordingly, the fixed wrench assembly 200 is configured to be secured to joints having a wide range of diameters. As previously introduced, the fixed wrench assembly 200 is further configured to have a drive assembly 400 (FIGS. 1A-1C, FIG. 4) coupled thereto. In one example, the drive assembly 400, not shown, and the fixed wrench assembly 200 may be integrally formed with the floating wrench assembly 300. In other examples, the fixed wrench assembly 200 may be permanently secured to drive assembly 400. In still other examples the drive assembly 400 (FIG. 4) may be removably coupled to the fixed wrench assembly 200, which is the configuration illustrated in FIG. 2. In addition, the fixed wrench assembly 200 can include jaws 280, such as non-pivoting flat jaws, that are joined to the wrench body 210 by pivots 289 that pass through at least one of the pivot holes 226, 236.

Figure 3:
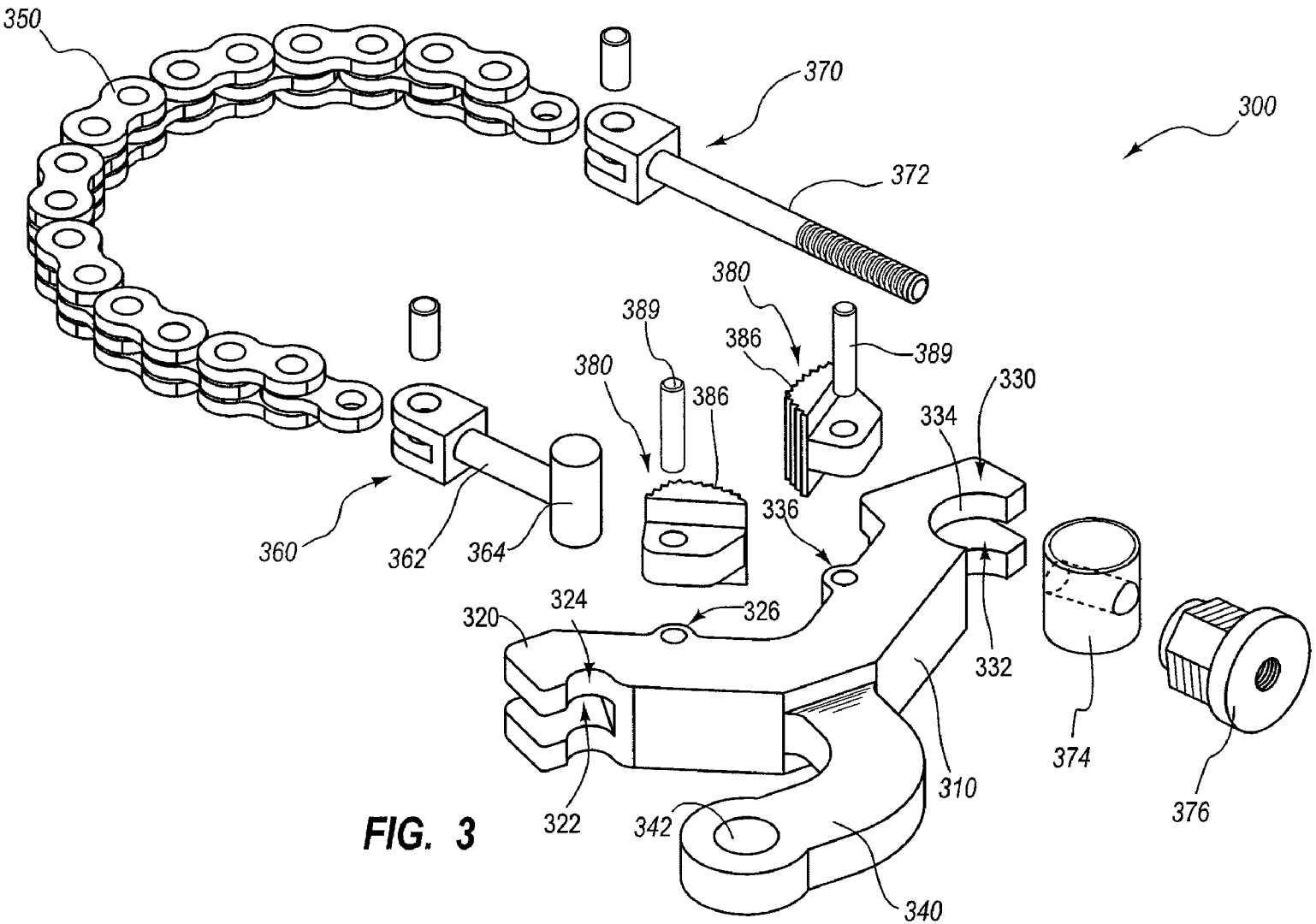
FIG. 3 illustrates an exploded view of a floating wrench assembly according to one example.

FIG. 3 illustrates a floating wrench 300 according to one example. The floating wrench 300 may have a similar configuration as the fixed wrench 200 or may have a different configuration. Accordingly, as illustrated in FIG. 3, the fetter 350 is configured to be removably coupled to the first engagement arm 320 by the first coupler 360 and to the second engagement arm 330 by the second coupler 370. The first coupler 360 in turn may include a transverse member 362 that is configured to enter a channel 322 as well as extend therethrough. The first coupler 360 further includes a pivot pin 364 secured to the transverse member 362. The pivot pin 364 is configured to engage a recess 324 in such a manner that may allow the first couple 360 to pivot relative to the first engagement arm 320 while the two are engaged.

The second coupler 370 can also be configured to be coupled to the second engagement arm 330 in such a manner that the second coupler 370 is able to rotate relative to the second engagement arm 330 while the two are engaged. The second coupler 370 in turn may include a threaded rod 372, a swivel 374, and a nut 376. The threaded rod 372 may be configured to pass through a hole 332 and through the swivel 374. The swivel 374 in turn may be sized to engage the second engagement arm 330 at the recess 334.

The nut 376 may then be screwed on to the threaded rod 372 to thereby maintain the swivel 374 in engagement with the second engagement arm 330 at the recess 334. As the nut 376 is further threaded onto the threaded rod 372, the threaded rod 372 advances through the nut 376 thereby drawing the fetter 350 closer to the second engagement arm 330.

If a rod casing or other rod is located between the fetter 350 and the wrench body 310, drawing the fetter 350 toward the second engagement arm 330 can tension the floating wrench assembly 300 to the rod. In at least one example, the nut 376 may be configured to allow an operator to tighten the nut by hand. Such a nut 376 may include or be coupled to a thumbwheel. In other examples, the nut 376 may include other configurations that allow hand-tightening, such as a wing nut or other type of nut.

Hand tightening the floating wrench assembly 300 may bring the floating wrench assembly 300 into engagement with a rod while allowing the rod to rotate relative to the floating wrench assembly 300 while the drive assembly 400 (FIGS. 1A-1C, FIG. 4) moves toward a retracted state. In this manner, the floating wrench assembly may be attached to the rod in such a manner so as to not rethread the joint as the cylinder rod of the breaking cylinder is retracted.

Any type of fetters may be used to connect the first connector and the second connector. Some examples of conventional fetters may include a leaf chain, a metal cable, a braid of metal cables, a metal strap, a belt, cast links pinned together, and so forth. The fetter 250 may be a heavy duty leaf chain, such as the Tsubaki model BL-846 with a one inch pitch and a tensile strength of about 46,200 lbs. In other examples, the fixed wrench assembly 200 and the floating wrench assembly 300 may be identical or may vary from each other in any manner.

A nut and bolt connector could then be used to tighten or loosen the fetters in order to allow a range of rod sizes to fit in the joint tool. The three and three quarter inch fetters could quickly be removed and replaced with larger or smaller fetters. For instance, the three and three quarter inch fetters may be replaced with 19½ inch fetters.

Figure 4:
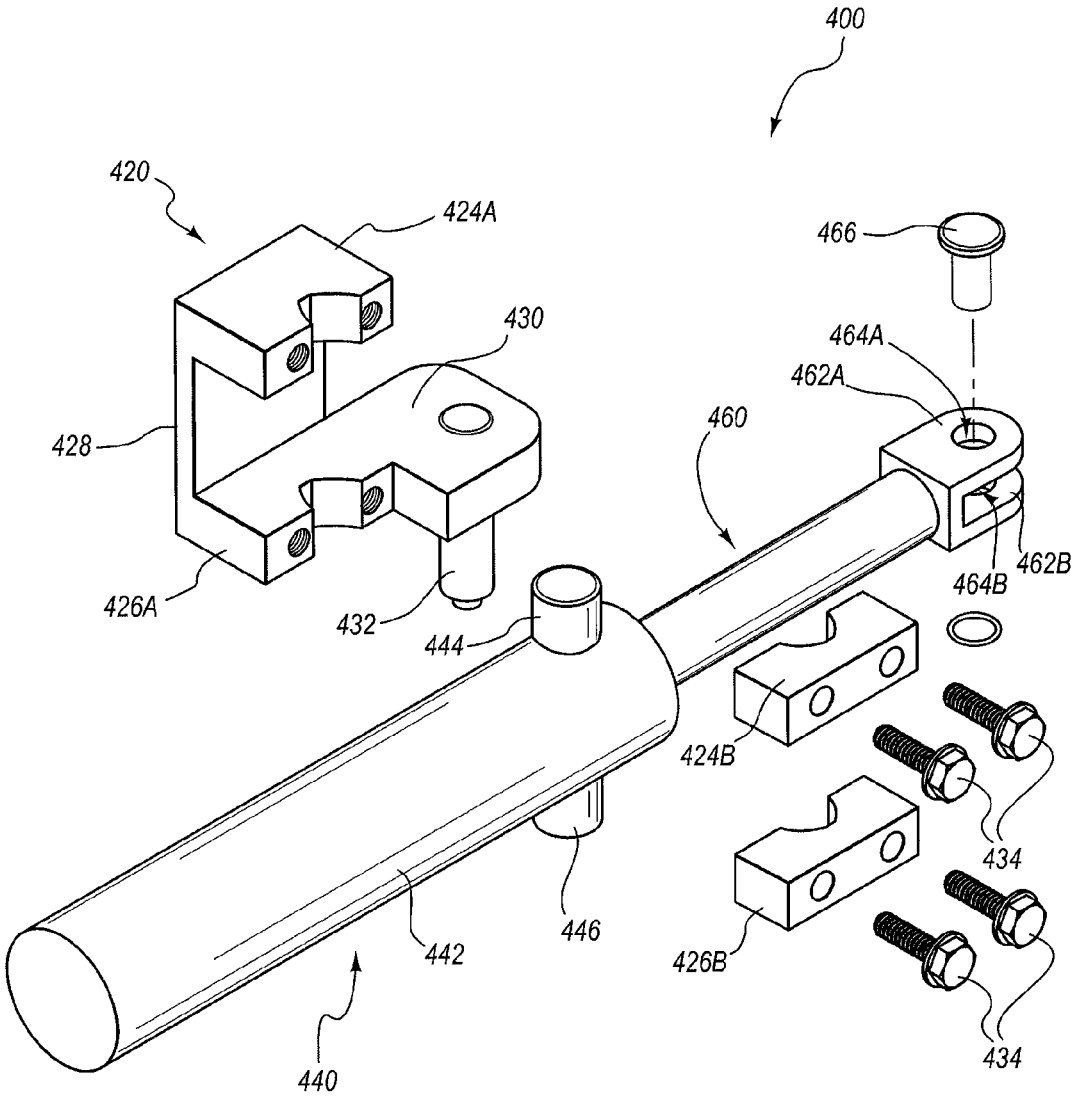
FIG. 4 illustrates an exploded view of a drive assembly according to one example.

FIG. 4 illustrates an exploded view of the drive assembly 400. As previously introduced, the drive assembly 400 generally includes the cylinder 440 secured to the mount 420. In particular, as illustrated in FIG. 4 the mount 420 may include a body having a top clamp half 424A and a bottom clamp half 426A joined by a vertical support 428. The mount 420 may also include a horizontal tab 430 secured to the bottom clamp half 426. A mount pin 432 is secured to the horizontal tab 430 and extends away from the bottom clamp half 426A. Opposing clamp halves 424B, 426B are configured to be secured to top clamp half 424A and bottom clamp half 426A respectively with fasteners 434, such as bolts. In the illustrated example, the fasteners 434 are configured to extend through the opposing clamp halves 424B, 426B and thread into the bottom and top clamp halves 424A, 426B.

As the fasteners 434 are threaded into the top and bottom clamp halves 424A, 426A, the fasteners 434 draw the opposing clamp halves 424B, 426B toward the top and bottom clamp halves 424B, 426B. This configuration allows the mount 420 to have the cylinder 440 secured thereto. In particular, the cylinder 440 may include a housing 442. Pins 444, 446 may be secured to opposing sides of the housing 442. The pins 444, 446 may be positioned between the top and bottom clamp halves 424A, 426A. As the fasteners 434 are threaded as described above, the opposing clamp halves 424B, 426B and the top and bottom clamp halves 424B, 426B will be tightened against the pins 444, 446, thereby securing the cylinder 440 to the mount 420.

As previously introduced, the drive assembly 400 further includes a rod 460 that is configured to be extended away from and retracted toward the cylinder 440. In at least one example, the rod and cylinder may be a linear actuator. Any type of linear actuator may be used, such as electric, hydraulic or other types of linear actuators.

In the illustrated example, the rod 460 further includes opposing tabs 462A, 462B with pivot holes 464A, 464B defined therein. Either or both of the pivot holes 464A, 464B are configured to receive a pin 466. Accordingly, the pin 466 may extend through either or both of the pivot holes 464A, 464B. The configuration of the mount 420 as well as the rod 460 allow the drive assembly 400 to be coupled to the fixed wrench assembly 200 as well as the floating wrench assembly 300, which will now be described in more detail.

As previously introduced, during a joint breaking process, the fixed wrench assembly 200 may first be secured on one side of the joint. Thereafter, the drive assembly 400 may be coupled to the fixed wrench assembly 200. In at least one example, the drive assembly 400 may be coupled to the fixed wrench assembly 200 by locating the mount 420 relative to the lever 240 and then passing the mount pin 432 at least partially through the pivot hole 242 in the lever arm 240. The mount pin 432 may be secured to the lever arm 240 in any manner, such as by a nut, a cotter pin, a snap ring, other retention devices or combinations thereof. Accordingly, the mount 420 may couple the drive assembly 400 to the fixed wrench assembly 200.

The drive assembly 400 can then be coupled to the floating wrench assembly 300. In the illustrated example, the rod 460 may be coupled to the lever arm 340. With continuing reference to FIG. 1B, the pin 466 and tabs 462A, 462B may be configured to couple the rod 460 to the floating wrench 300. In particular, the lever arm 340 of the wrench body 310 may be dimensioned to allow the wrench body 310 to be placed at least partially between the tabs 462A, 462B. Further, wrench body 310 may be aligned relative to the rod 460 such that the pivot holes 464A, 464B in the tabs 462A, 462B are aligned with the pivot hole 342 in the lever arm 340.

The pin 466 may be passed through the tabs 462A, 462B and the lever arm 340. The pin 466 may then be secured in any suitable manner, such as by a nut, a cotter pin, a snap ring, other retention devices or combinations thereof. Thereafter, the floating wrench assembly 300 may be positioned relative to the joint and the fetter 350 coupled to the wrench body 310 as described above to capture the rod within the floating wrench assembly 300. Once the joint tool 100 has been positioned relative to the joint, the joint tool 100 may then be used to break the joint as will now be described in more detail.

Figure 5A:
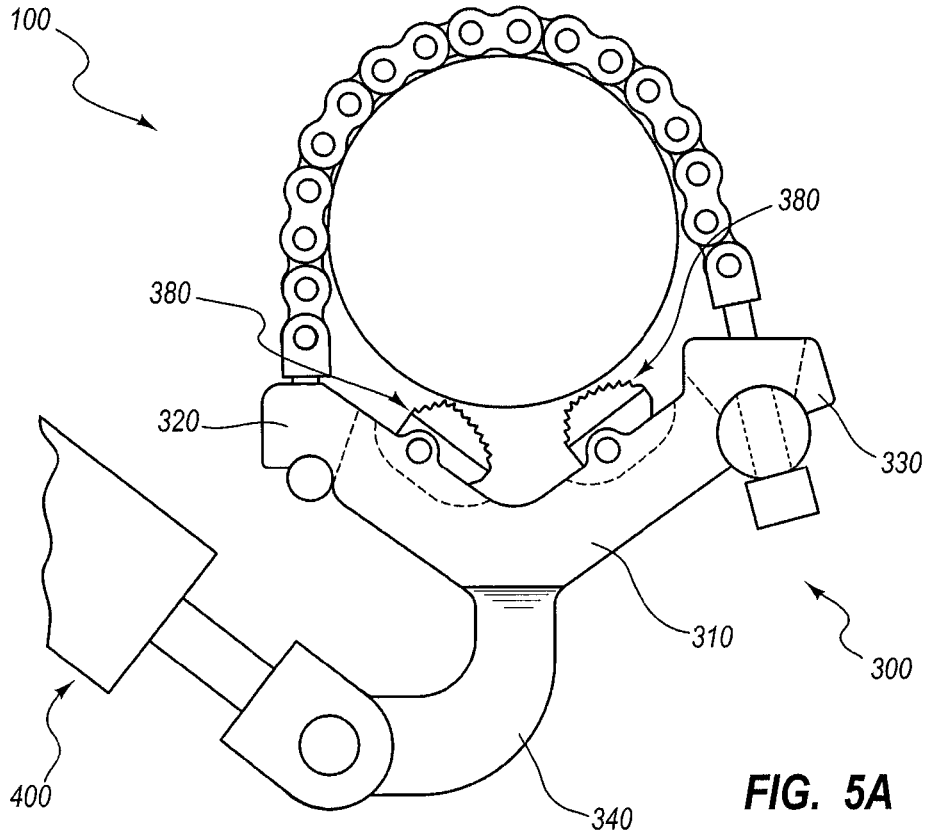
FIG. 5A is a top view of a joint tool according to one example.

FIG. 5A illustrates a top view of the joint tool 100 in which the floating wrench assembly 300 is shown in initial engagement with the second drill rod 120B. The fetter 350 can be wrapped partially around the drill rod 120B and the first coupler 360 and/or the second coupler 370 can be tightened to draw the wrench body 310 toward the second drill rod 120B. In such a configuration, the floating wrench assembly 300 is wrapped around the second drill rod 120B.

Figure 5B:
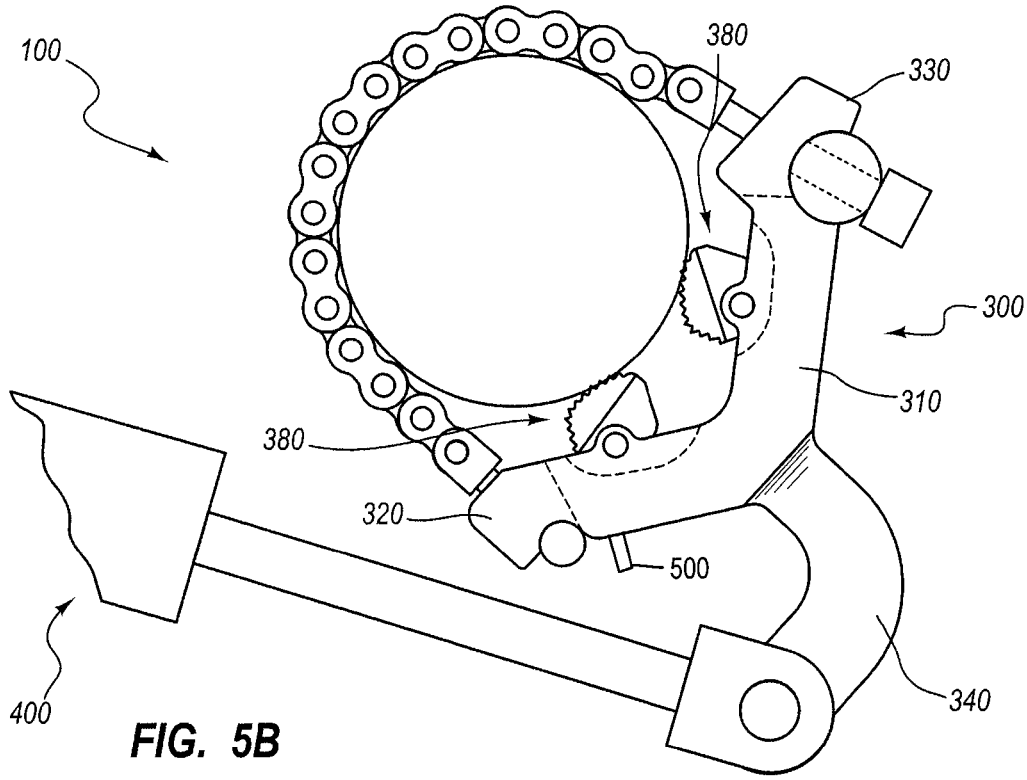
FIG. 5B is a top view of a joint tool according to one example.

As illustrated in FIGS. 5A-5B, the lever arm 340 on the floating wrench assembly 300 may allow the rod 460 to be fully extended without hitting the first engagement arm 320 of the floating wrench assembly 300. Consequently, a lever arm 340 may be of any desired length and may be designed for optimal extension of the rod 460 and/or rotation of the floating wrench assembly 300.

In the position illustrated in FIG. 5A, the jaws 380 are brought into contact with the second drill rod 120B. Further, in the position illustrated in FIG. 5A the drive assembly 400 is in a relatively retracted position. The drive assembly 400 may then be actuated to drive the rod 460 toward the extended position.

FIG. 5B illustrates the rod 460 moving toward the extended position. As the rod 460 moves toward the extended position, the rod 460 causes the floating wrench assembly 300 to begin to rotate around the second drill rod 120B in a breaking direction. As the floating wrench assembly 300 rotates in the breaking direction, the jaws 380 rotate in such a manner that the floating wrench assembly 300 grips the second drill rod 120B.

In particular, in the example illustrated the jaws 380 may be pivoting jaws and/or may have a cam-like profile such that as the jaws move due to relative rotation in the breaking direction. One such jaw 380 is illustrated in more detail in FIG. 6A. The jaw 380 generally includes a body 382 having a first side 382A and a second side 382B. The body 382 can have any profile or shape that allows the jaw 380 to move into increasing engagement when pivoted in a breaking direction and to decreasing engagement when pivoted in a tightening direction.

In at least one example, the body 382 is configured to rotate about a pin 389 that has been passed through one or more pivot holes 384 defined in the body 310. The body 310 also includes a contact surface 386 that is configured to be brought into engagement with a rod. The pivot hole 384 may be formed at a location that is offset from the center of the body 382. The pivot hole 384 is offset toward the second side 382B of the body 382 such that a relatively larger portion of the body 382 is located toward the first side 382A than the second side 382B relative to an engaged rod such that the body 382 forms a cam. As a result, when the body 382 rotates in the breaking direction, indicated by arrow B, the first side 382A of the body 382 is located between the pivot hole 384 and the rod with which the jaw 382 is in contact.

Figure 6C:
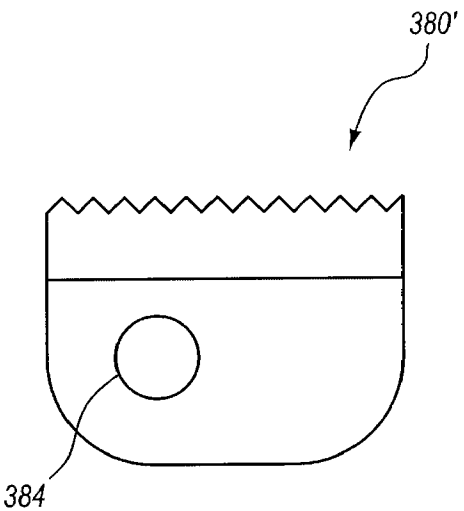
FIG. 6C illustrates a jaw according to one example.
Figure 6B:
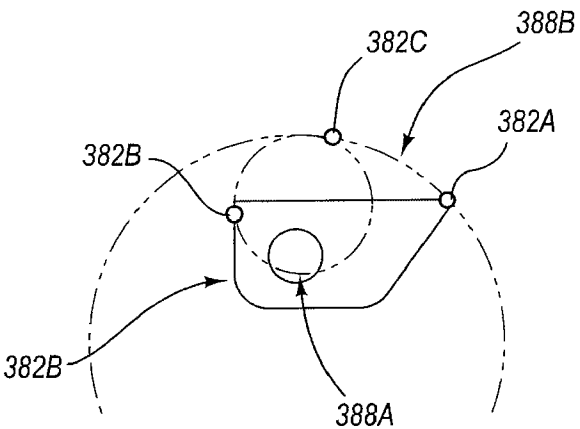
FIG. 6B illustrates a jaw according to one example.

In addition to an offset pivot hole 384, the contact surface 386 may also be shaped as desired. For example, the contact surface 386 may also have a cam-shape profile. The contact surface 386 shown has a lopsided semi-circular profile. FIG. 6B further shows that, in one exemplary embodiment, the second side 382B and part of the contact surface 386 follow the circumference of a small circle 388A from the second side 382A to point 382C. The rest of the contact surface 386 from point 382C to the first side 382A follows the circumference of a larger circle 388B. The contact surface 386 may further have teeth formed thereon to reduce or eliminate slipping of the jaw 380 as the jaw 380 grips and/or rotates the second drill rod 120B.

One example of a suitable jaw 380 may be a jaw 380 that is pivotally connected to the floating wrench assembly and that has a cam profile, as described herein. Such a pivoting jaw 380 with a cam profile may pivot towards a rod and cause the wrench to grip the rod when the wrench is moved in one direction. Conversely, such a pivoting cam profile jaw may release its grip and pivot slightly away from the rod (although it may still be in contact with the rod) when the wrench is moved in the opposite direction.

As illustrated in FIG. 6B, as the floating wrench assembly 300 rotates, engagement between the contact surface 386 and the second drill rod 120B rotates the engagement feature 382 in such a manner that the second side 382B is closer to the wrench body 310 than the first side 382A. Positioning the second side 382B closer to the wrench body 310 drives the second drill rod 120B toward the fetter 350, thereby causing the floating wrench assembly 300 to grip the second drill rod 120B.

In at least one example, one or more grip limiters 500 may be associated with or more jaw. As illustrated in FIG. 5B, the grip limiter 500 may extend through the wrench body 310. In such a configuration, the grip limiter 500 may control the rotation of the jaws 380. Controlling the rotation of the jaw 380 may in control the cam effect of the jaws 380, which may in turn limit the amount of grip the floating wrench assembly 300 applies to a rod. Further, the grip limiter 500 may be used to further adjust the grip of the jaws 380 for rods of different characteristics (i.e., size, texture, hardness, etc.). Accordingly, the floating wrench assembly 300 may include pivoting jaws that help to grip the rod when the floating wrench is moved in a first direction and to slip past the rod when pivoted in a second direction that is opposite the first direction.

Jaws can be coupled to a wrench in any desired manner. Some examples of appropriate methods to connect the jaws to a wrench may include the use of one or more pins, tongues in grooves, bolts, rivets, etc. FIG. 3 illustrates one example where two pivoting jaws 380 are connected to the floating wrench assembly 300 with pins 389 that are inserted through holes 326, 336 in the wrench body 310. Thus, the pivotable jaws 380 may be easily removed, replaced, reoriented, and so forth.

Figure 6A:
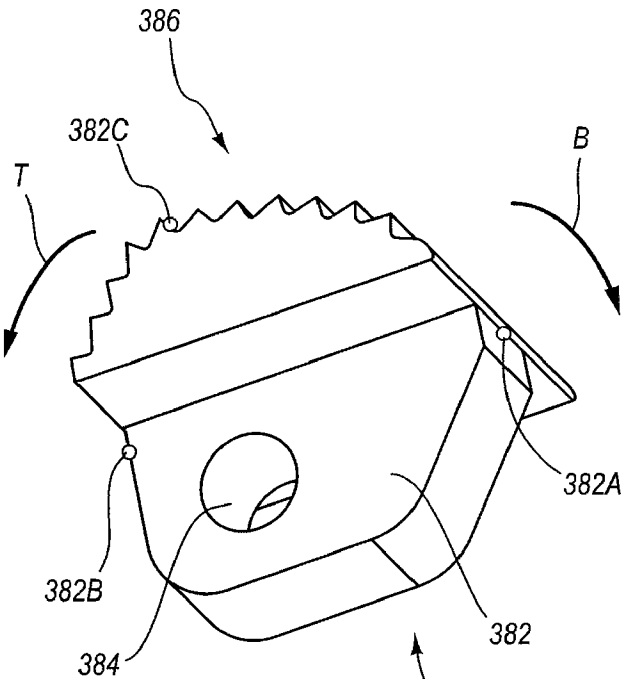
FIG. 6A illustrates a jaw according to one example.
Figure 6E:
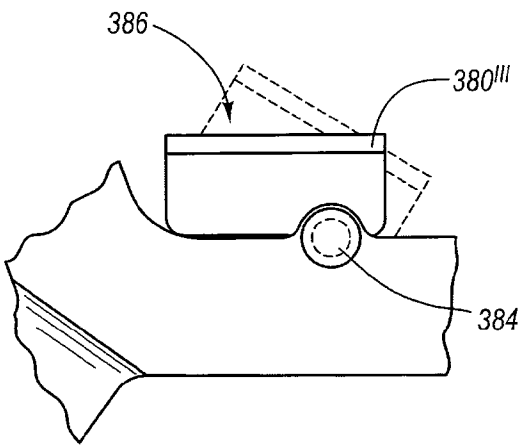
FIG. 6E illustrates a jaw according to one example.
Figure 6F:
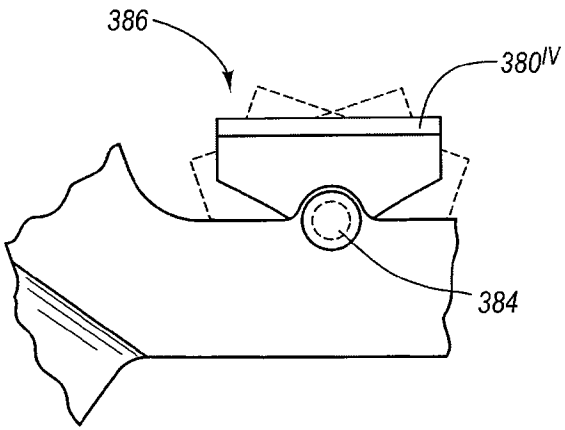
FIG. 6F illustrates a jaw according to one example.
Figure 6D:
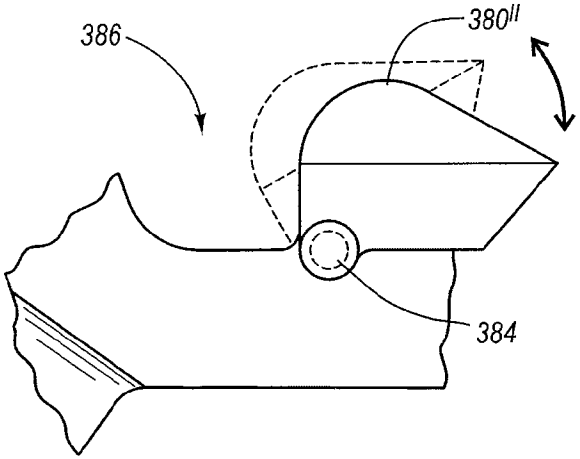
FIG. 6D illustrates a jaw according to one example.

Pivoting engagement features may have various configurations. For example FIG. 6C illustrates a pivoting, jaw 380' that includes a non-cammed contact surface 386' with teeth formed thereon. The teeth may have an angle relative to a nominal flat surface of about 30 degrees. FIG. 6D-6F show jaws 380$^{ii}$-380$^{iv}$ with various shapes and having a pivot holes 384 located in various positions with contact surfaces of various shapes. To this point, pivoting jaws have been described. These jaws have been described in connection with a floating wrench assembly 300. In other examples, non-pivoting jaws may be provided.

Figure 7:
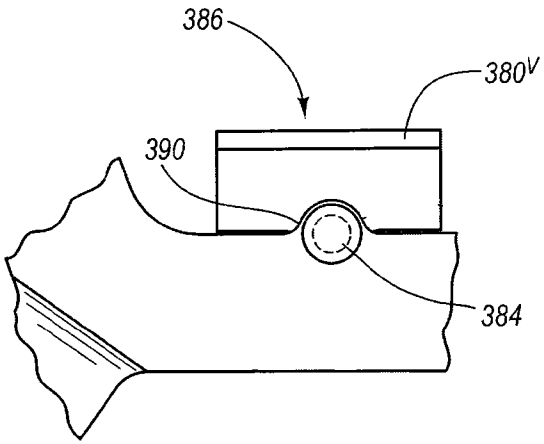
FIG. 7 illustrates a jaw according to one example.

FIG. 7 illustrates that a flat profile jaw 380*v* that can be connected to a fixed wrench assembly 200 (FIG. 2) through the lower center of the jaw 380*v* and has an inner surface 390 that is flat. Such a configuration may reduce or prevent rotation of the jaw 380*v* due to contact between the inner surface 390 and a wrench body, such as the wrench body 310 (FIG. 3).

Pivoting and/or non-pivoting jaws may be provided in any combination with the floating wrench assembly 300 and/or the fixed wrench assembly 200. The contact surfaces and/or inner surfaces of any fixed and/or pivotable jaw(s) that comes in contact with a drill rod may have any desired texture and/or shapes. Thus, the jaws may be designed to increase friction or to "bite" a rod, as desired. By way of illustration, the contact surface of the jaws may have teeth, it may be smooth, it may be rough, it may be crosshatched, it may be knurled, it may be diamond coated, it may contain carbide inserts, and so forth. In some embodiments, one or both of the wrenches may contain jaws. The two wrenches need not have the same type or number of jaws.

In at least one example, fixed jaws may optionally be formed as part of a wrench assembly. Additionally, fixed jaws may be fastened in, on, or to a wrench assembly in any desired manner. Some ways of attachment may include one or more pins, bolts, rivets, epoxies, welds, etc. Further, jaws may be fastened to a wrench assembly, such as the fixed wrench assembly 200, by placing the fixed jaw in a groove defined in the fixed wrench assembly 200.

Once the fixed jaw is set in the groove, a jaw pin may be placed through jaw holes in the wrench body 210 the fixed jaw. Additionally, a retaining ring may be placed in a groove in the wrench body, to prevent the jaw pin from becoming dislodged. The jaw pin may therefore allow the fixed jaw to be easily removed and/or replaced.

Fixed jaws may also have any profile known in the art. For example, the fixed jaws may have a flat profile, a cam profile, a "V" profile, or an elliptical profile. The proximal end of both pivotable and fixed jaws may have any desired shape and may be connected to a wrench in any desired orientation. In at least one example, the different shapes of a gripping and orientation may affect whether a jaw is fixed or whether it is pivotable. Moreover, for jaws that do pivot, the jaws' orientation and shape of the proximal end may affect the extent to which a jaw may pivot in any given direction.

As introduced, contact surfaces may have teeth formed thereon. The teeth may point in any direction(s) and may be of any desired size(s), shape(s), or type(s). For example, FIGS. 6A and 6C illustrate contact surface with triangular teeth. In those Figures, the three angles of the each triangular tooth may be approximately thirty degrees, ninety degrees, and sixty degrees, moving left to right. In such an example, the peak of the triangular teeth, or the 90 degree angle, may grip or bite into a drill rod, especially when the fetter of the wrench corresponding wrench is moving into gripping contact with a rod while the associated wrench assembly is rotated in a breaking direction and to allow the rod to slip over the teeth as the wrench assembly is rotated in the tightening direction.

In some instances, the pivotable jaws may be biased by a spring. A spring may bias the pivoting jaw in a desired direction to enhance or reduce grip of the jaws as desired. The joint tool may use any type of breaking cylinder to force a wrench in either direction. Some suitable examples of breaking cylinders may include any type of linear actuator, hydraulic cylinder, pneumatic cylinder, solenoid, and the like. The breaking cylinder may have any desired feature that allows or helps it perform this breaking function. For example a breaking cylinder may be any size, may have any desired strength, may be uni- or bi-directional, may have a cylinder rod of any desired length, and the like. Additionally, while the breaking cylinder may comprise a breaking cylinder barrel, a breaker mount, and a cylinder rod, it need not have each of these elements provided it can function in this manner.

In at least one example, a floating wrench assembly and a fixed wrench assembly may be similar or substantially the same. In at least one of such examples, the floating wrench assembly and the fixed wrench assembly may be similar, even if they are used in the same or different orientations. In other examples, the wrenches assemblies may be different in one or several aspects. Further, the floating wrench and the fixed wrench may have any desired difference.

Another example of a suitable jaw may be a ratchetable wheel. Any known ratchetable wheel may be used as a jaw. Such a wheel may spin as a wrench moves around the rod in one direction and may not move as the wrench moves around the rod in the opposite direction. Additionally, such a ratchetable wheel may be bi-directional, or it may be adjusted from ratcheting in one direction to ratcheting in the opposite direction.

Another example of a suitable pivotable jaw may include any type of jaw that slides on and/or in the wrench as the wrench turns in one direction. Such a jaw may slide as a wrench is moved in one direction, and thereby allow the wrench to move across the drill rod without threading or unthreading the joint. However, when a wrench with one or more such slidable jaws is turned in the opposite direction, the slidable jaws may slide back to their original position and may grip the rod so that the rod moves along with the wrench.

In at least one example, the joint tool 100 may be modular so that the joint tool may be regularly disassembled into multiple components and easily reassembled. Thus, the joint tool may be manually portable. In such an example, the joint tool may be broken into any desired components as well as any number of desired components. For example, in some examples, the joint tool may be broken into three pieces as described above. In other examples, the joint tool may be broke into more or less pieces as desired. Such configurations may allow the joint tool to be manually assembled such that assembly can be accomplished without auxiliary equipment to move it into position as desired. In fact, in some examples the joint tool may be so light and portable that just one worker could transport, install, and use the joint tool. In this way, a worker may be able to take the joint tool to a desired joint, instead of trying to raise or lower the drill rod to position the joint for the tool. Thus, the joint tool may be versatile and be used in situations that may normally require hand wrenches or movement of the drill rod(s) to auxiliary breaking equipment.

Each of the aforementioned components of the joint tool may be made of any desired material or combination of materials. For example, the wrench bodies, the fetter, the jaws, the cylinder rod, and so forth may be made of any desired metal, ceramic, steels, and/or the like. For instance, some examples of suitable metals may include steel, iron, titanium, brass, bronze, and/or aluminum. Some examples of suitable ceramic-containing materials may include oxides, borides, carbides, and nitrides of compositions such as aluminum, boron, zirconium, beryllium, silicon, titanium, tungsten, and iron. Additionally, some examples of ceramic matrix composite compositions that may be used for construction of the aforementioned components may include tungsten carbide, alumina, silicon carbide, zirconium carbide, aluminum nitride, aluminum carbide, and boron carbide.

Also, the breaking cylinder may be powered through any conventional system, such as hydraulic power. For example, a breaking cylinder could be powered by the auxiliary function of a drill power pack, by a power pack, by hydraulic power from an unsecured function, by a diesel engine from a driven power pack, by an electric motor from a driven power pack, by an air/hydraulic pump, and so forth. In some embodiments, a hydraulic breaking cylinder may be powered by a modified hydraulic power pack from a truck or all-terrain-vehicle ("ATV") snow plow assembly. In such embodiments, any plow hydraulic power pack with any modification(s) may be used to power the breaking cylinder of the joint tool. Consequently, the joint tool may be used anywhere that is truck or ATV accessible.

The joint tool may be used for many purposes. For example, as described above, the joint tool may be used to break joints and/or unthread rod sections. In fact, the joint tool may be used in combination with any other known tool (e.g., hand wrenches) to break and/or unthread joints.

The joint tool may also be operated in any position. For example, the joint tool may be used to break/unthread joints that are in a vertical position, as depicted in FIG. 1. In another example, the joint tool may be used to break/unthread joints that are in a horizontal position. Indeed, the joint tool may be used on rods that are in any orientation.

The joint tool as described above is used primarily to break and/or unthread a joint. To make and/or thread a joint, the components of the tools can re-configured to allow the joint tool to make a joint and/or thread sections of drill rod together. In some embodiments, the jaws may be re-configured to switch the joint tool from a breaking/unthreading mode to a making/threading mode by making a mirror image of the upper and lower wrench body of the casing breaker.

In addition to any variation previously mentioned, the joint tool may be modified in any manner and may have any desired variation. In some variations, the joint tool may have multiple breaking cylinders. One breaking cylinder may be used for making joints and the other breaking cylinder may be used for breaking joints. Additionally, where multiple breaking cylinders are used, one may be used as a backup if the first jams or is damaged. In other variations, the joint tool could have a plurality of wrenches on a side of a joint, thereby increasing the number of wrenches in a single joint tool to 3 (or more).

In addition to any previously indicated modification, numerous other variations and alternative arrangements may be devised by those skilled in the art without departing from the spirit and scope of the invention, and appended claims are intended to cover such modifications and arrangements. Thus, while the invention has been described above with particularity and detail in connection with what is presently deemed to be the most practical and preferred aspects of the invention, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

What is claimed is:

1. A joint tool, comprising:

a first wrench assembly configured to be placed in gripping contact with a first rod;

a second wrench assembly including at least two jaws configured to selectively grip a second rod, said second wrench assembly being adapted to rotate the second rod relative to the first rod when said second wrench assembly is rotated in a first direction, said second wrench assembly being further adapted to rotate relative to the second rod when said second wrench assembly is rotated in a second direction, said second wrench comprising an engagement arm, wherein said at least two jaws are pivotally coupled to said engagement arm, a fetter adapted to be adjustably coupled at both ends thereof to said engagement arm, and an arcuate lever arm coupled to said engagement arm between said at least two jaws; and a drive assembly operatively associated with said first wrench assembly and said second wrench assembly, said drive assembly being configured to rotate said second wrench assembly in the first direction and the second direction, and wherein said drive assembly is pivotally coupled to said lever arm.

2. The tool of claim 1, wherein said first wrench assembly and said second wrench assembly are each pivotally coupled to the drive assembly.

3. The tool of claim 1, wherein said first wrench assembly includes at least one jaw, said at least one jaw of said first wrench assembly being configured to grip the first rod when said first wrench assembly is rotated in a first direction and to slip over the first rod when said first wrench assembly is rotated in a second direction.

4. The tool of claim 3, wherein said at least one jaw of said first wrench assembly is a pivoting jaw.

5. The tool of claim 4, wherein said pivoting jaw of said first wrench includes a body having a first side and a second side and further comprising a pivot hole defined in said body, said pivot hole being offset from a center of said body toward said first side.

6. The tool of claim 4, wherein said pivoting jaw of said first wrench includes a contact surface configured to contact the first rod, said contact surface having a cam-profile surface.

7. The tool of claim 1, wherein said first wrench assembly is a fixed wrench assembly and said second wrench assembly is a floating wrench assembly, said floating wrench assembly being configured to rotate relative to said fixed wrench assembly in said first direction to break a joint.

8. The tool of claim 1, wherein said drive assembly is adapted to maintain said first wrench assembly in a generally stationary position while rotating said second wrench assembly in the first direction and the second direction.

9. A joint tool for use in manipulating the joints of connected drill rods of a drill string, comprising:

a first wrench assembly adapted to engage a first rod;

a second wrench assembly adapted to engage a second rod, said second wrench assembly being adapted to rotate in a first direction relative to said first wrench assembly and rotate in a second direction relative to said first wrench assembly, said second wrench comprising an engagement arm, at least one jaw pivotally coupled to said engagement arm, a fetter adapted to be adjustably coupled at both ends thereof to said engagement arm, and a lever arm coupled to said engagement arm; and a drive assembly operatively associated with said first wrench assembly and said second wrench assembly, said drive assembly adapted to rotate said second wrench assembly in said first direction relative to said first wrench assembly and said second direction relative to said first wrench assembly to manipulate a joint between the first and second rods, and wherein said drive assembly comprises a cylinder, a rod movably coupled to said cylinder, said rod being coupled at a first end thereof to said second wrench assembly, and a mount coupled to a first end of said cylinder, said mount pivotally coupling said first wrench assembly to said second wrench assembly at a first pivot point, wherein said first pivot point is positioned between said first end of said cylinder and said first end of said rod.

10. The tool of claim 9, wherein said second wrench assembly is adapted to grippingly engage the second rod when said second wrench assembly is rotated in the first direction so as to cause axial rotation of the second rod in the first direction.

11. The tool of claim 10, wherein said second wrench assembly is adapted to slip around the second rod when said second wrench assembly is rotated in the second direction such that said second wrench assembly rotates relative to the second rod without causing substantial axial rotation of the second rod in the second direction.

12. The tool of claim 11, wherein said at least one jaw facilitate the gripping engagement between said second wrench assembly and the second rod when said second wrench assembly is rotated in the first direction, and wherein said at least one jaw facilitate the slipping of said second wrench assembly around the second rod when said second wrench assembly is rotated in the second direction.

13. The tool of claim 12, wherein said at least one jaw includes a body having a first side and a second side and further comprising a pivot hole defined in the body, said pivot hole being offset from a center of said body toward said first side.

14. The tool of claim 9, wherein said first wrench assembly is a fixed wrench assembly and said second wrench assembly is a floating wrench assembly, said floating wrench assembly being configured to rotate the second rod relative to said fixed wrench assembly and the first rod in the first direction to break a joint between the first rod and the second rod.

15. The tool of claim 9, wherein movement of said drive assembly rod relative to said cylinder causes rotation of said second wrench assembly relative to said first wrench assembly.

16. A joint tool for use in manipulating a joint between connected rods, the joint tool comprising:

a fixed wrench assembly configured to be grippingly secured to a first rod to limit axially rotation of the first rod relative to said fixed wrench assembly during manipulation of the joint;

a floating wrench assembly including at least one jaw configured to selectively engage a second rod, said floating wrench assembly adapted to axially rotate the second rod when said floating wrench assembly is rotated in a first direction, said at least one jaw further configured to disengage the second rod when said floating wrench assembly is rotated in a second direction, the second direction being different than the first direction; and a drive assembly coupled to said fixed wrench assembly and said floating wrench assembly, wherein said drive assembly is adapted to move said floating wrench assembly in the first direction and the second direction, wherein said drive assembly comprises a cylinder, a rod movably coupled to said cylinder, said rod being coupled at a first end thereof to said floating wrench assembly, and a selectively removable mount coupled to a first end of said cylinder, said mount pivotally coupling said fixed wrench assembly to said floating wrench assembly at a first pivot point, wherein said first pivot point is positioned between said first end of said cylinder and said first end of said rod.

17. The tool of claim 16, wherein extension of said drive assembly rod relative to said cylinder moves said floating wrench assembly in the first direction, thereby causing said at least one jaw to grippingly engage and rotate the second rod in the first direction, and wherein retraction of said drive assembly rod relative to said cylinder moves said floating wrench assembly in the second direction and allows said floating wrench assembly to move relative to the second rod.

18. The tool of claim 16, wherein said fixed wrench assembly is coupled to said mount to substantially maintain the position of said fixed wrench relative to said floating wrench assembly when said drive assembly rod is extended from or retracted into said cylinder.

19. The tool of claim 16, wherein said fixed wrench assembly includes a substantially non-pivoting jaw to facilitate gripping engagement of said fixed wrench assembly to the first rod.

20. A joint tool for use in manipulating a joint between a rod and a second rod, the joint tool comprising:

a fixed wrench assembly having at least one jaw, wherein said at least one jaw is configured to facilitate secure engagement of said fixed wrench assembly to the first rod to substantially prevent axially rotation of said fixed wrench assembly relative to the first rod during manipulation of the joint;

a floating wrench assembly adapted to move in a first direction and a second direction relative to said fixed wrench assembly, said floating wrench assembly having at least two pivoting jaws configured to selectively pivot into and out of gripping engagement with the second rod, wherein each of said at least two pivoting jaws pivots into gripping engagement with the second rod when said floating wrench assembly is moved in the first direction, thereby enabling said floating wrench assembly to grip and axially rotate the second rod relative to the first rod when said floating wrench assembly is moved in the first direction, and wherein each of said at least two pivoting jaws pivots out of gripping engagement with the second rod when said floating wrench assembly is moved in the second direction, thereby allowing said floating wrench assembly to move relative to the second rod, said floating wrench assembly comprising an engagement arm, wherein said at least two pivoting jaws are pivotally coupled to said engagement arm, and an arcuate lever arm coupled to said engagement arm between said at least two pivoting jaws; and a drive assembly coupled to said fixed wrench assembly and said floating wrench assembly, wherein said drive assembly is adapted to move said floating wrench assembly in the first direction and the second direction relative to said fixed wrench assembly, wherein said drive assembly comprises a selectively removable mount for pivotally coupling said fixed wrench assembly to said floating wrench assembly, wherein said mount is capable of pivoting with respect to said fixed wrench assembly.

21. The tool of claim 20, wherein said fixed wrench assembly and said floating wrench assembly are spaced apart such that the joint connecting the first rod and the second rod is disposed between said fixed wrench assembly and said floating wrench assembly.

22. The tool of claim 20, wherein said drive assembly comprises a cylinder secured to said mount, and a drive assembly rod associated with said cylinder, wherein said drive assembly rod is adapted to be extended out of and retracted into said cylinder.

23. The tool of claim 22, wherein said cylinder is pivotally secured to said mount.

24. The tool of claim 22, wherein said floating wrench assembly is coupled to an end of said drive assembly rod such that extension and retraction of said cylinder causes movement of said floating wrench assembly in the first direction and the second direction, respectively.

25. The tool of claim 20, wherein at least one of said fixed wrench assembly and said floating wrench assembly is selectively adjustable to facilitate engagement with rods of varying sizes.

* * * * *

UNITED STATES PATENT AND TRADEMARK OFFICE

CERTIFICATE OF CORRECTION

PATENT NO. : 7,997,166 B2
APPLICATION NO. : 12/138297
DATED : August 16, 2011
INVENTOR(S) : Lauzon et al.

It is certified that error appears in the above-identified patent and that said Letters Patent is hereby corrected as shown below:

Column 1
Line 12, change "to apparatus" to --to an apparatus--

Column 3
Line 55, change "illustrates" to --illustrate--

Column 6
Line 8, change "such on" to --such as on--
Line 52, change "nut be sized" to --nut can be sized--

Column 7
Line 15, change "first couple 360" to --first coupler 360--

Column 8
Line 5, change "half 426" to --half 426A--
Line 12, change "424A, 426B" to --424A, 426A--
Line 23, change "424B, 426B" to --424A, 426A--

Column 9
Line 49, change both instances of "body 310" to --body 382--
Line 60, change "jaw 382" to --jaw 380--

Column 10
Line 26, change "with or more jaw" to --with one or more jaws--
Line 30, remove [in]
Line 52, change "FIG. 6D-6F" to --FIGS. 6D-6F--
Line 53, change "having a pivot holes" to --having a pivot hole--

Signed and Sealed this
Twenty-second Day of November, 2011

David J. Kappos

David J. Kappos
*Director of the United States Patent and Trademark Office*

Column 11
Line 3, change “shapes” to --shape--
Line 43, after “the fetter of the” remove [wrench]

Column 12
Line 1, change “wrenches assemblies” to --wrench assemblies--
Line 30, change “broke” to --broken--

Column 13
Line 17, change “can re-configured” to --can be re-configured--
Line 59, change “comprising” to --comprising:--

Column 14
Line 40, change “comprising” to --comprising:--

Column 15
Line 6, change “facilitate” to --facilitates--
Line 9, change “facilitate” to --facilitates--

Column 16
Lines 27-28, change “comprising” to --comprising:--